US005247158A

United States Patent [19]

Steinhauser et al.

[11] Patent Number: 5,247,158

[45] Date of Patent: Sep. 21, 1993

[54] ELECTRICAL HEATER

[75] Inventors: Louis P. Steinhauser; Randal A. Schmitz; Hugh G. Dopplick, all of St. Louis, Mo.

[73] Assignee: Watlow Electric Manufacturing Company, St. Louis, Mo.

[21] Appl. No.: 916,184

[22] Filed: Jul. 17, 1992

[51] Int. Cl.[5] ..... H05B 3/44; H05B 3/50

[52] U.S. Cl. ..... 219/544; 219/541; 219/534

[58] Field of Search ..... 219/544, 541, 534, 536, 219/523; 338/238-241, 274, 275

[56] References Cited

U.S. PATENT DOCUMENTS

| | | | |
|---|---|---|---|
| 1,922,150 | 8/1933 | Beresh | 219/523 |
| 2,177,508 | 10/1939 | Abbott | 338/238 |
| 2,334,756 | 11/1943 | Eichinger | 174/102 |
| 2,341,235 | 2/1944 | Palmer | 174/102 |
| 2,351,056 | 6/1944 | Lepetit | 174/102 |
| 2,831,951 | 4/1958 | Desloge | 201/67 |
| 2,899,664 | 8/1959 | Andrews | 338/240 |
| 2,961,632 | 11/1960 | Hachmeister et al. | 339/136 |
| 3,205,296 | 9/1965 | Davis et al. | 174/34 |
| 3,252,122 | 5/1966 | Baxter | 338/271 |
| 3,301,941 | 1/1967 | Christensen | 174/88 |
| 3,310,769 | 3/1967 | Simmons | 338/241 |
| 3,353,260 | 11/1967 | Davis et al. | 29/573 |
| 3,530,423 | 9/1970 | Davis | 339/89 |
| 3,582,616 | 6/1971 | Wrob | 219/541 |
| 3,668,598 | 6/1972 | Drugmand et al. | 338/274 |
| 3,694,789 | 9/1972 | Brown | 338/238 |
| 3,742,422 | 6/1973 | Rozema et al. | 338/257 |
| 3,808,575 | 4/1974 | Brandt et al. | 338/262 |
| 3,812,580 | 5/1974 | Drugmand | 29/611 |
| 3,839,623 | 10/1974 | Portmann | 219/541 |
| 3,881,163 | 4/1975 | Lindroth et al. | 338/302 |
| 3,890,485 | 6/1975 | Kozbelt | 219/523 |
| 3,920,963 | 11/1975 | Beasley et al. | 219/523 |
| 3,970,816 | 7/1976 | Hosokawa et al. | 219/523 |
| 4,186,369 | 1/1980 | Attridge et al. | 338/274 |
| 4,300,038 | 11/1981 | Schwarzkopf | 219/544 |
| 4,314,401 | 2/1982 | Saku | 29/611 |
| 4,346,287 | 8/1982 | Desloge | 219/541 |
| 4,395,623 | 7/1983 | Shimada et al. | 219/544 |
| 4,593,182 | 6/1986 | Schwarzkopf | 219/544 |
| 4,617,455 | 10/1986 | Schwarzkopf | 219/523 |
| 4,626,665 | 12/1986 | Fort, III | 219/534 |
| 5,034,595 | 7/1991 | Grendys | 219/541 |

*Primary Examiner*—Bruce A. Reynolds
*Assistant Examiner*—Michael D. Switzer
*Attorney, Agent, or Firm*—Senniger, Powers, Leavitt & Roedel

[57] ABSTRACT

An electrical heater comprising a heating element, a tubular metal sheath surrounding the heating element and spaced therefrom, insulation inside the sheath for electrically insulating the heating element from the sheath, and a closure closing one end of the sheath. A passaging extends through the closure in a direction generally lengthwise of the sheath. At least one power lead adapted for connection to a source of electrical energy extends through the passaging for conducting electrical energy to the heating element. The power lead includes an electrical conductor, a metallic sleeve surrounding the conductor, and insulation for electrically insulating the conductor from the sleeve. The conductor has a terminal portion electrically connected to the heating element. A seal between the closure and the sheath around the one end of the sheath seals against the passage of contaminants between the closure and the sheath. A seal between the power lead and the closure seals against the passage of contaminants through the passaging in the closure. The arrangement is such that the closure and the seals seal against the passage of contaminants into or out of the heater through the one end of the sheath.

19 Claims, 2 Drawing Sheets

ELECTRICAL HEATER

BACKGROUND OF THE INVENTION

This invention relates generally to electrical resistance heaters and, more particularly, to electrical sheath heaters.

Sheath heaters, such as cartridge heaters, conventionally comprise a resistance element, typically coiled on an insulating core, and a metal sheath that is coaxial with the coil and core and radially spaced from the coil. A mineral insulating material having an optimum combination of relatively high thermal conductivity and relatively low electrical conductivity fills the space between the sheath and the coil. Power is delivered to the heater through internal lead pins contained within longitudinal holes in the core where they are held in electrical contact with the resistance element. External leads, having insulating sleeves, are connected to the lead pins and extend through an open end of the heater.

When power leads are in high temperature environments (e.g., in excess of 1000° F.), insulating sleeves often become baked out and brittle. When this happens, any amount of flexing of the external leads causes the sleeves to fray and thereby expose the conductors, with the likely result being electrical shorting between the conductors or a grounded surface.

Another problem frequently encountered by sheath heaters is contamination of the internal components. Contamination occurs when foreign materials enter the heater and cause a breakdown of the coil or surrounding insulation. The contaminants may cause a gross electrical shorting or an accelerated deterioration of the internal elements of the heater. Heaters that are subject to large temperature swings or frequent cycling are most susceptible to ingesting harmful contaminants. When a heater heats up and cools down causing thermal expansion and contraction of the air inside it, it "breathes" surrounding gasses or liquids—as well as any contaminants within the gasses or liquids.

Another problem encountered by sheath heaters is contamination by the heaters of the environments they are used in. Contamination (i.e., outgassing) occurs when moisture and/or gasses escape from the heater. In some applications—such as when the heater is being used in a vacuum environment—outgassing may be undesirable or unacceptable.

SUMMARY OF THE INVENTION

Among the objects of the present invention may be noted the provision of an improved sheath heater which overcomes the disadvantages and deficiencies associated with the prior art devices; the provision of such a sheath heater having power leads capable of withstanding high temperatures; the provision of such a sheath heater which prevents contaminants from entering the heater; and the provision of such a sheath heater which prevents contaminants escaping from the heater.

Generally, an electrical heater of the present invention comprises a heating element, a tubular metal sheath surrounding the heating element and spaced therefrom, insulation inside the sheath for electrically insulating the heating element from the sheath, and a closure closing one end of the sheath. Power lead means adapted for connection to a source of electrical energy extend through passaging through the closure, the passaging extending in a direction generally lengthwise of the sheath. The power lead means comprises electrical conductor means, metallic sleeve means surrounding the conductor means, and insulation means electrically insulating the conductor means from the sleeve means. The conductor means has terminal portions electrically connected to the heating element. A seal between the closure and the sheath around the one end of the sheath seals against the passage of contaminants between the closure and the sheath. A seal between the power lead means and the closure seals against the passage of contaminants through the passaging in the closure. The arrangement is such that the closure and the seals seal against the passage of contaminants into or out of the heater through the one end of the sheath.

Other advantages and features will be in part apparent and in part pointed out hereinafter.

BRIEF DESCRIPTION OF THE DRAWINGS

Corresponding reference characters indicate corresponding parts throughout the several views of the drawings.

DESCRIPTION OF THE PREFERRED EMBODIMENTS

Figure 1:
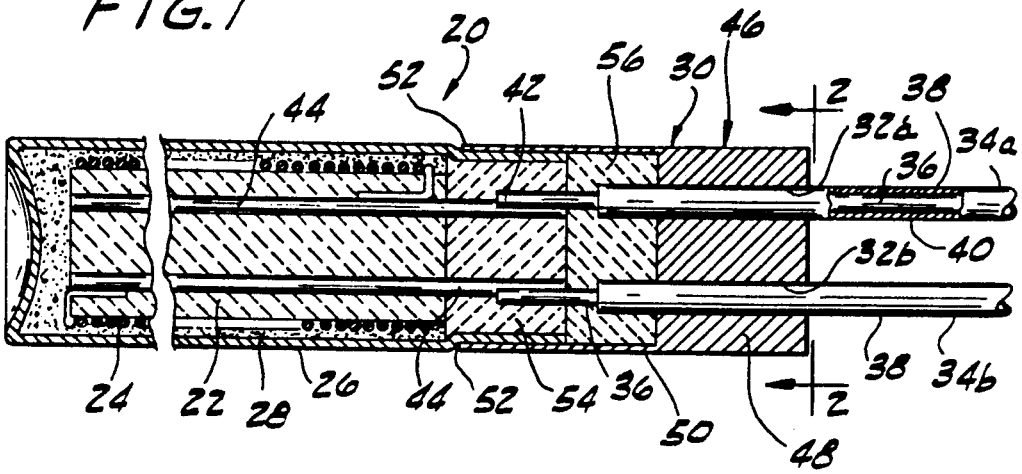
FIG. 1 is a longitudinal sectional view of an electrical heater of the present invention.
Figure 2:
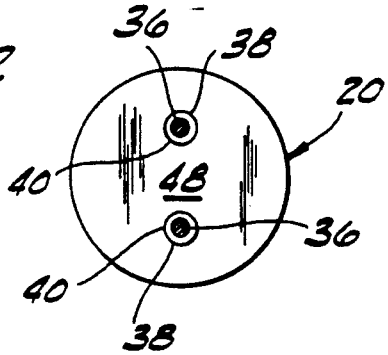
FIG. 2 is a section on line 2—2 of FIG. 1.

Referring to FIGS. 1-2, an electrical heater of the invention, generally indicated at 20, is shown to include a ceramic core 22 around which is wrapped a helical heating element 24. Surrounding the heating element 24 and radially spaced therefrom is a tubular metal sheath 26. Insulation material 28 in the space between the heating element 24 and the sheath 26 electrically insulates the heating element from the sheath. The insulation material 28 is preferably magnesium oxide or another particulate insulation material having good thermal conductivity and high electrical insulation properties at high temperatures. A closure, designated generally at 30, closes one end of sheath 26 (its right end as viewed in FIG. 1). A pair of holes **32*a*, 32*b* extend through closure 30 in a direction generally lengthwise of sheath 26. The holes 32*a*, 32*b* constitute passaging through closure 30. A pair of bendable power leads 34*a*, 34*b*, adapted for connection to a source of electrical energy, extend through holes 32*a*, 32*b*, respectively. Each power lead comprises an electrical conductor 36, a metallic sleeve 38 around the conductor, and insulation 40 for electrically insulating the conductor 36 from the sleeve 38. The conductors 36 may be of stranded or solid wire, but are preferably of solid wire of a metal (e.g., nickel) suitable for high temperature use. The insulation 40 comprises a high temperature dielectric material such as, for example, magnesium oxide. Each conductor 36 has a terminal portion 42 connected to a corresponding internal lead pin 44. The lead pins 44** electrically connect the terminal portions 42 of the conductors to the heating element 24. In the preferred embodiment, the terminal portion 42 of each conductor 36 is connected to one of the lead pins 44 by a lapped connection as described in U.S. Pat. No. 4,346,287, incorporated herein by reference.

The closure 30 comprises a cap 46 having a head 48 (preferably approximately ¼" thick) and an annular skirt 50 extending endwise from the head 48. The skirt 50 has an overlapping telescopic fit with the open end of the sheath 26. While the cap 46 is illustrated as being of one-piece construction, it will be understood that it could be formed in more than one piece, as by a metal plug sealingly secured (e.g., welded) in one end of a metal sleeve or tube. Preferably the closure 30 is made of a gas-impermeable material resistant to high temperatures. In the preferred embodiment, the closure 30 is made of a metallic nickel alloy available from the International Nickel Company, Inc., under the trademark Incoloy®. The closure 30 and sheath 26 are sealed together to seal against the passage of contaminants between the closure 30 and the sheath 26. The skirt 50 and sheath 26 are preferably welded together by a weld 52 between the skirt 50 and sheath 26 around the circumference of the sheath 26 to form the seal. The seal can also be formed by a close sealing pressure fit between the skirt 50 and the end of the sheath 26. The close fit is accomplished by laterally compressing the skirt, such as by swaging, to reduce its diameter to form an interference fit so that the skirt 50 is sealed all around the sheath 26. It is to be understood that, alternatively, the skirt 50 could be joined to the sheath 26 by brazing, soldering or gluing, rather than by welding and/or swaging, provided the closure 30 and alternative seal seals against the passage of contaminants between the closure 30 and the sheath 26.

The sleeves 38 of the power leads 34*a*, 34*b* are also preferably made of a refractory metal such as 304 stainless steel. The sleeves 38 have a close interference fit in the holes 32*a*, 32*b* through the head 48 of the cap 46, the fit preferably being formed by a swaging operation on the cap 46 to reduce the cross-sectional area of the head 48. This results in a corresponding reduction in the cross-sectional area of holes 32*a* and 32*b* so that the head 48 is sealed around the sleeves 38. These interference fits constitute seals which seal against the passage of contaminants through holes 32*a* and 32*b*. The sleeves 38 may also be brazed, soldered or glued to the head 48 all around the sleeves 38 to further ensure a gas-impermeable seal. Internal electrically insulating plugs 54, 56, preferably made of crushable ceramic, fill the space between the cap 46 of the closure 30 and the end of the ceramic core 22 for electrically insulating the terminal portions 42 of the conductors 36. Leads constructed in accordance with this invention can withstand temperatures as high as 1800° F.

Figure 3:
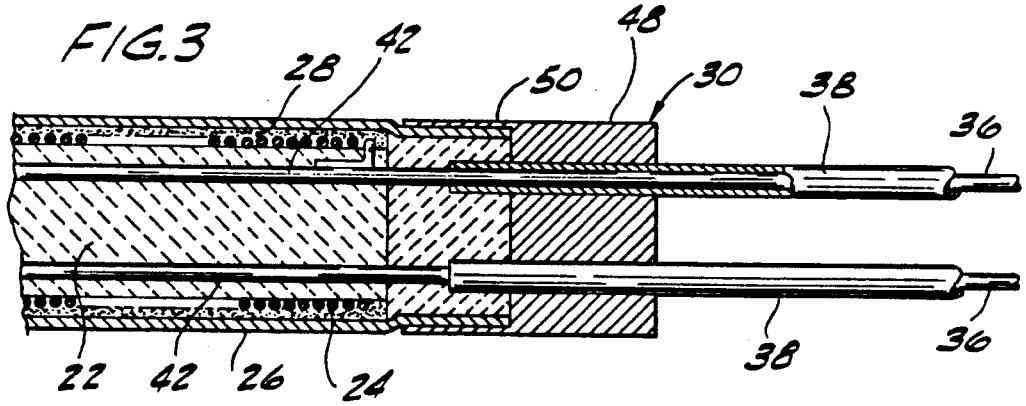
FIG. 3 is a view similar to FIG. 1 showing an alternative embodiment of an electrical heater similar to the heater of FIG. 1 except the electrical conductors of the power leads extend through the core of the heater.

FIG. 3 shows an alternative preferred embodiment of an electrical heater similar to the embodiment of FIG. 1 except the terminal portions 42 of the conductors 36 extend through the core 22 and replace the internal lead pins (designated 44 in FIG. 1).

Figure 4:
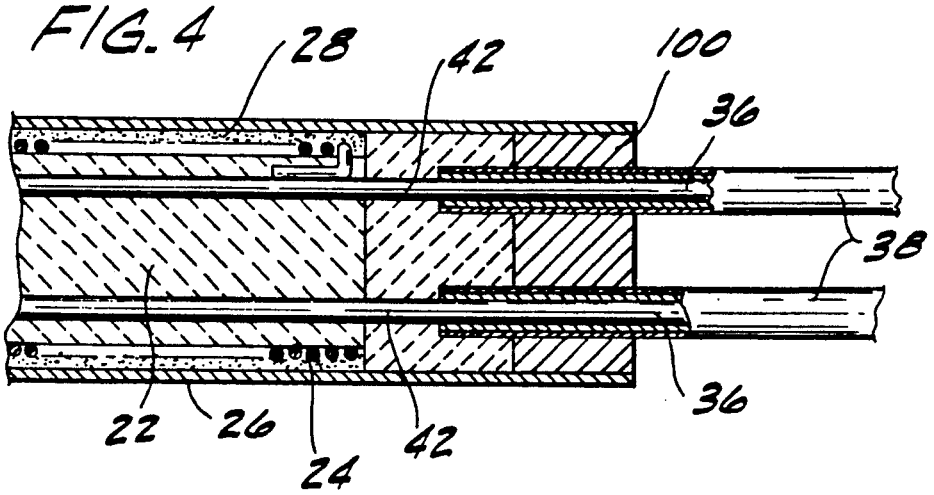
FIG. 4 is a view similar to FIG. 3 showing an alternative embodiment of an electrical heater similar to the heater of FIG. 3 except the closure comprises a plug in an end of the sheath.

FIG. 4 shows an alternative preferred embodiment of an electrical heater similar to the embodiment of FIG. 3 except the closure comprises a metallic plug 100 plugging one end of the sheath 26 (its right end as viewed in FIG. 4). The plug 100 and sheath 26 are sealed together to seal against the passage of contaminants between the plug 100 and the sheath 26. Preferably, the end of sheath 26 is swaged on plug 100 to form an interference fit and sheath 26 and plug 100 are welded together by a weld around the circumference of plug 100. Alternatively, plug 100 could be sealed to sheath 26 by brazing, soldering or gluing.

Figure 5:
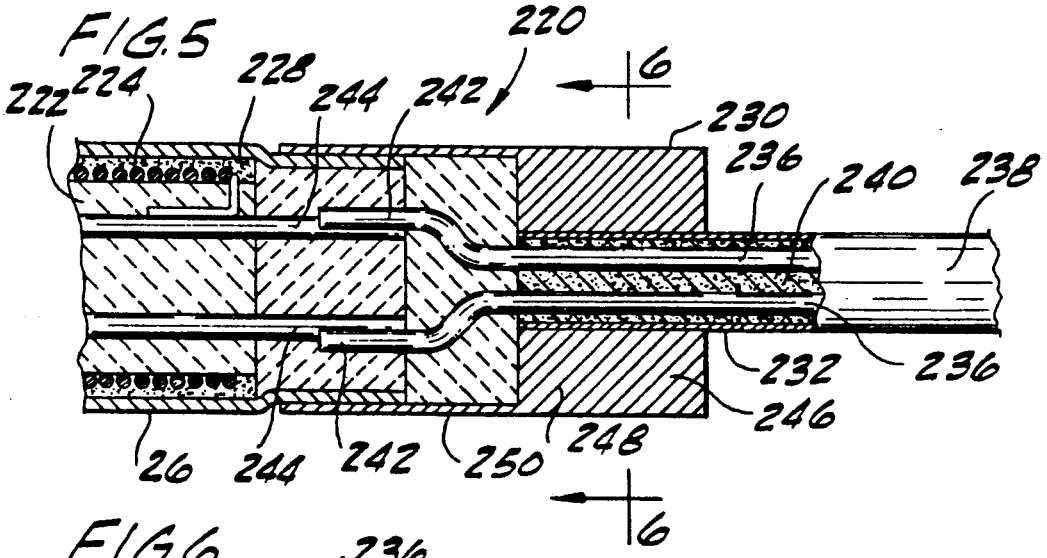
FIG. 5 is a longitudinal sectional view of an alternative embodiment of an electrical heater having two electrical conductors surrounded by a single sleeve.
Figure 6:
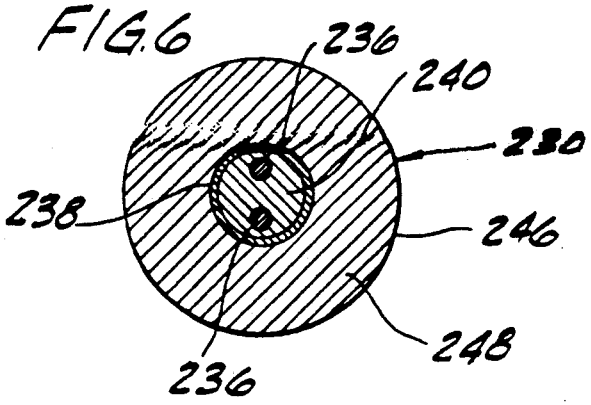
FIG. 6 is a section on line 6—6 of FIG. 5.

FIGS. 5 and 6 show another alternative preferred embodiment of an electrical heater, generally indicated at 220. The heater 220 is similar to the heater 20 of FIGS. 1-2 except the power lead means of heater 220 has one metallic sleeve 238 surrounding two conductors 236. For convenience, corresponding parts are numbered the same as those parts shown in FIGS. 1-2 except the prefix "2" has been added to the reference numbers.

The heater 220 includes a ceramic core 222 around which is wrapped a helical heating element 224. Surrounding the heating element 224 and radially spaced therefrom is a tubular metal sheath 226. Insulation material 228 in the space between the heating element 224 and the sheath 226 electrically insulates the heating element from the sheath. A closure, designated generally at 230, closes one end of sheath 226. Passaging comprising a single hole 232 extends through closure 230 in a direction generally lengthwise of sheath 226. The sleeve 238 and conductors 236 extend through hole 232. The conductors 236 are adapted for connection to a source of electrical energy. Insulation 240 within sleeve 238 electrically insulates the conductors 236 from each other and from sleeve 238. Each conductor 236 has a terminal portion 242 connected to a corresponding internal lead pin 244. The closure 230 comprises a cap 246 having a head 248 and an integral annular skirt 250. The closure 230 and cap 246 are preferably sealed by welding and swaging. Also, sleeve 238 is sealed to closure 230 preferably by swaging of the closure to reduce the cross-sectional area of the hole 232.

In the preferred embodiments of this invention, the arrangements of the closures, sheaths, and seals, seal against the passage of contaminants into or out of the heater. It is to be understood, however, that the closure could be made of a gas-permeable material, such as mica or ceramic, without departing from the scope of this invention.

It is to be further understood that the invention may be embodied in heaters which contain a heating element of either coiled or other configuration within a sheath, but which do not utilize a core for support of the heating element.

Also, while the heaters have been shown as being generally circular in cross section, it is contemplated that the heater may be of any cross-sectional shape including square or rectangular.

Moreover, although the power leads 34*a*, 34*b* have been described as having only one conductor 36, it is to be understood that each power lead could have more than one conductor. The heater could also have more than one heating element with separate pairs of conductors for each heating element. Additional leads, such as thermocouple leads, may also be included.

In view of the above, it will be seen that the several objects of the invention are achieved and other advantageous results attained.

As various changes could be made in the above constructions without departing from the scope of the invention, it is intended that all matter contained in the above description or shown in the accompanying drawings shall be interpreted as illustrative and not in a limiting sense.

What is claimed is:

1. An electrical heater comprising:

a heating element;

a tubular metal sheath surrounding said heating element and spaced therefrom;

insulation inside the sheath electrically insulating the heating element from the sheath;

a metallic, gas-impermeable closure closing one end of the sheath, said closure comprising a metal head;

passaging through the head of the closure extending in a direction generally lengthwise of the sheath;

power lead means extending through said passaging in the head of the closure and adapted for connection to a source of electrical energy for conducting electrical energy to said heating element, said power lead means comprising electrical conductor means, metallic sleeve means surrounding said conductor means, and insulation means between said metallic sleeve means and said conductor means electrically insulating said conductor means from said sleeve means, said conductor means having terminal portions electrically connected to the heating element;

said power lead means, including said conductor means, metallic sleeve means and insulation means, being operable at high temperatures in excess of 1000° F.;

a seal between the closure and the sheath around said one end of the sheath to seal against the passage of contaminants between the closure and the sheath; and a seal between the metal head of the closure and said metallic sleeve means of said power lead means to seal against the passage of contaminants through said passaging in the head;

the arrangement being such that the closure and said seals seal against the passage of contaminants into or out of the heater through said one end of the sheath.

2. An electrical heater as set forth in claim 1 wherein said closure further comprises an annular metallic skirt extending endwise from the head, said skirt having an overlapping telescopic fit with said one end of the metal sheath.

3. An electrical heater as set forth in claim 2 wherein the seal between the closure and the sheath is formed, at least in part, by a close sealing fit between the skirt and said one end of the sheath.

4. An electrical heater as set forth in claim 3 wherein the seal between the closure and the sheath further comprises a weld between the skirt and the sheath around the circumference of the sheath.

5. An electrical heater as set forth in claim 2 wherein the seal between the closure and the sheath comprises a weld between the skirt and the sheath around the circumference of the sheath.

6. An electrical heater as set forth in claim 1 wherein said power lead means comprises two separate power leads, wherein said electrical conductor means comprises a pair of electrical conductors, one in each said power lead, wherein said metallic sleeve means comprises a pair of metallic sleeves, each surrounding a respective one of the electrical conductors, and wherein said insulation means comprises insulation electrically insulating each electrical conductor from its respective metallic sleeve.

7. An electrical heater as set forth in claim 6 wherein said closure further comprises an annular metallic skirt extending endwise from the head, said skirt having an overlapping telescopic fit with said one end of the metal sheath.

8. An electrical heater as set forth in claim 7 further comprising insulation in the skirt of the closure between the head of the closure and said one end of the sheath for electrically insulating the power leads from one another.

9. An electrical heater as set forth in claim 8 wherein the head of said closure is approximately ¼" thick.

10. An electrical heater as set forth in claim 6 wherein the seal between the head of the closure and the sleeve means comprises a swaged interference sealing fit between each sleeve and the head of the closure.

11. An electrical heater as set forth in claim 6 wherein the insulation for electrically insulating each conductor from its respective sleeve comprises a high temperature dielectric material.

12. An electrical heater as set forth in claim 11 wherein the dielectric material comprises magnesium oxide.

13. An electrical heater as set forth in claim 6 further comprising at least two internal lead pins, each lead pin electrically connecting one of said terminal portions to the heating element.

14. An electrical heater as set forth in claim 6 wherein said head comprises a metallic plug plugging one end of the metal sheath.

15. An electrical heater as set forth in claim 1 wherein said power lead means comprises two electrical conductors, wherein said metallic sleeve means comprises a single metallic sleeve surrounding the two conductors, and wherein said insulation means comprises insulation for electrically insulating the conductors from each other and from the sleeve.

16. An electrical heater as set forth in claim 1 wherein said head and said power lead means are non-rotatable relative to one another.

17. An electrical heater as set forth in claim 1 wherein said closure is an integral, one-piece member.

18. An electrical heater comprising:

a heating element;

a tubular metal sheath surrounding said heating element and spaced therefrom;

insulation inside the sheath electrically insulating the heating element from the sheath;

a metallic, gas-impermeable closure closing one end of the sheath, said closure comprising a metal head;

a pair of holes through the head of the closure extending in a direction generally lengthwise of the sheath;

a pair of power leads each extending through a corresponding one of the holes in the head of the closure and adapted for connection to a source of electrical energy for conducting electrical energy to said heating element, each of said power leads comprising an electrical conductor, a metallic sleeve surrounding said conductor, and insulation between said metallic sleeve and said conductor electrically insulating said conductor from said sleeve, said conductor having terminal portions electrically connected to the heating element;

said power leads, including said conductors, said metallic sleeves, and said insulation, being operable at high temperatures in excess of 1000° F.;

a seal between the closure and the sheath around said one end of the sheath to seal against the passage of contaminants between the closure and the sheath; and seals between the metal head of the closure and said metallic sleeves of said power leads to seal against the passage of contaminants through said passaging in the head;

the arrangement being such that the closure and said seals seal against the passage of contaminants into or out of the heater through said one end of the sheath.

19. An electrical heater as set forth in claim 18 wherein said closure is an integral, one-piece member, and wherein said seals between the head of the closure and said metallic sleeves each comprises a swaged interference sealing fit.

* * * * *